US007334302B2

(12) United States Patent
Segawa et al.

(10) Patent No.: US 7,334,302 B2
(45) Date of Patent: Feb. 26, 2008

(54) BOTTOM END STOP FOR SLIDE FASTENER

(75) Inventors: Kiyomasa Segawa, Toyama-ken (JP); Sakae Aimono, Toyama-ken (JP)

(73) Assignee: YKK Corporation, Tokyo (JP)

( * ) Notice: Subject to any disclaimer, the term of this patent is extended or adjusted under 35 U.S.C. 154(b) by 102 days.

(21) Appl. No.: 11/126,603

(22) Filed: May 11, 2005

(65) Prior Publication Data

US 2005/0251975 A1 Nov. 17, 2005

(30) Foreign Application Priority Data

May 14, 2004 (JP) ..... 2004-145416

(51) Int. Cl.
*A44B 19/36* (2006.01)

(52) U.S. Cl. ..... 24/433

(58) Field of Classification Search ..... 24/381, 24/387, 388, 418, 436, 403–406, 409, 410, 24/411–415, 433

See application file for complete search history.

(56) References Cited

U.S. PATENT DOCUMENTS

| | | | | |
|---|---|---|---|---|
| 1,785,715 | A | 12/1930 | Norton | |
| 2,289,586 | A * | 7/1942 | Marinsky et al. | 24/384 |
| 2,522,327 | A * | 9/1950 | Winterhalter | 24/435 |
| 2,701,401 | A * | 2/1955 | Dorman | 24/433 |
| 3,104,438 | A * | 9/1963 | Scarpini | 24/433 |
| 4,104,767 | A * | 8/1978 | Warren | 24/433 |
| 4,152,813 | A * | 5/1979 | Heimberger | 24/434 |
| 4,441,235 | A * | 4/1984 | Kusayama | 24/433 |
| 4,447,936 | A * | 5/1984 | Kusayama | 24/433 |
| 4,858,284 | A * | 8/1989 | Yoshimura | 24/433 |
| 7,036,191 | B2 * | 5/2006 | Tsaur | 24/433 |

FOREIGN PATENT DOCUMENTS

| | | |
|---|---|---|
| GB | 1479363 | 7/1977 |
| JP | 36-19078 | 3/1959 |
| JP | 59-25217 | 7/1984 |

* cited by examiner

*Primary Examiner*—Jack W. Lavinder
(74) *Attorney, Agent, or Firm*—Alston & Bird LLP

(57) ABSTRACT

The invention provides a bottom end stop for a slide fastener having a sufficient strength and an excellent appearance, wherein bottom ends of fastener stringers provided with a first and a second member are inserted through shoulder mouths of a slider; the first and the second member slide along flanges of the slider respectively; while the first and the second member are rotated in the direction of approaching each other, coupling of a pair of coupling heads and coupling concave portions formed on opposing faces of the first and the second member can be carried out, also coupling of coupling heads and coupling concave portions can be carried out; and further, by setting the length of the second member having no engaging portion with a fastener element to be shorter than the length of the first member, rotation of the first and the second member can be carried out smoothly.

5 Claims, 12 Drawing Sheets

BOTTOM END STOP FOR SLIDE FASTENER

BACKGROUND OF THE INVENTION

1. Field of the Invention

The present invention relates to a bottom end stop for a slide fastener having a two-division type structure comprising a first member and a second member, which are attached to respective fastener stringers opposing each other, and more particularly to a bottom end stop for a slide fastener having a structure facilitating connecting of the first member and the second member, capable of obtaining a sufficient strength as the bottom end stop and providing an excellent appearance.

2. Description of the Related Art

Conventionally, a slide fastener has a top end stop and a bottom end stop provided on ends of fastener elements thereof so as to inhibit a slider from loosing out of a fastener element row. The bottom end stop connects the ends of opposing fastener stringers, thereby preventing the slider from loosing out. Thus, for example, a U-shaped metallic or resin bottom end stop has been used to connect the ends of the opposing fastener stringers, which is a typically employed structure.

In case of such a bottom end stop, however, it is necessary to attach the bottom end stop between the ends of the fastener stringers with a pair of opposing fastener stringers arranged in a line. Thus, this case has a problem that a mounting device specialized for the bottom end stop is required, thereby increasing production processes for manufacturing the slide fastener.

Further, according to another prevailing bottom end stop, instead of using the U-shaped bottom end stop, members constituting a bottom end stop are attached to individual fastener stringers, and after the members are attached, the same members are combined and connected together so as to form a bottom end stop.

According to a method of forming the bottom end stop, for example, each bottom end of the pair of fastener stringers is inserted through a shoulder mouth of the slider, the fastener stringer is moved downward relative to the slider, and the members inserted through the shoulder mouths are connected with each other to form the bottom end stop. As the type bottom end stop, a two-division type bottom end stop and three-division type bottom end stop are available depending on the configuration of the members to be attached to the fastener stringer.

As the two-division type bottom end stop, there have been proposed: a bottom end stop for a slide fastener having a similar shape to a fastener element (refer to U.S. Pat. No. 2,701,401); a bottom end stop for a fastener formed by connecting members constituting the bottom end stop, and then bonding and fixing overlapping portions of the members (refer to Japanese Utility Model Publication No. 59-25217), a bottom end stop of a slider chain in which a stopper for preventing the slider from loosing out is formed on members constituting the bottom end stop (refer to Great Britain Patent No. 1479363) and the like. Further, as the three-division type bottom end stop, a slide fastener with a terminal (refer to Japanese Patent Publication No. 36-19078) has been proposed.

In the slide fastener described in the U.S. Pat. No. 2,701,401, an engaging tooth 51 having protrusions 56, 57 facing in opposite directions on its front and rear surfaces is used as in the perspective view of FIG. 9. Bottom end stops 58 is produced by connecting three engaging teeth 51 through connecting portions 63, 64. Thus, protrusions 60, 61 facing in opposite directions are formed at an engaging head 59 of the bottom end stops 58, 58*a*. The pitch between the engaging heads 59, 59 is set to the same pitch interval as the mounting pitch interval of the engaging tooth 51, and they are connected with the connecting portions 63, 64.

As shown in FIGS. 9 to 11, the corner portion on the side of the tape side face opposite to the engaging head 59 in each engaging tooth 51 is chamfered. Likewise, in the bottom end stops 58, 58*a* formed by connecting three engaging teeth 51, the corner portion including the portion between the connecting portions 63, 64 on the side of the tape face is chamfered.

FIG. 10 shows a state in which by inserting the bottom end stops 58, 58*a* of fastener stringers 52, 52 through shoulder mouths of a slider 53 and then moving the slider 53 upward, the bottom end stops 58, 58*a* have begun to be connected with each other. In a state in which the same bottom end stops 58, 58*a* have begun to be connected with each other, the bottom end stops 58, 58*a* are guided to an enlarged width portion in a flange portion 54 of the slider 53 while maintaining their straight configurations and connected with each other successively from the bottom end side. At this time, part of the side edges of the fastener stringers 52 provided with the bottom end stops 58, 58*a* is deformed, so that the bottom end stops 58, 58*a* can escape to the sides of their opposing faces. Consequently, the bottom end stops 58, 58*a* are connected with each other successively while maintaining their straight configurations.

Since the bottom end stops 58, 58*a* have begun to be connected with each other, as the slider 53 rises, the engaging teeth 51 are connected with each other successively as shown in FIG. 11. When the slider 53 descends, the connection between the engaging teeth 51 is released by a wedge operation of a neck portion 55 of the slider 53, and the neck portion 55 makes contact with a top face of the head 59 of the bottom end stop 58*a*, thereby preventing the slider 53 from loosing out.

The bottom end stop for a fastener described in the Japanese Utility Model Publication No. 59-25217 is formed by connecting a long first sub-body and second sub-body. Steps are formed on opposing faces of the first sub-body and second sub-body. When the steps overlap, a protrusion (not shown) formed on the top face of the step on one side and a concave row (not shown) formed in the bottom face of the step on the other side engage each other.

A curved concave portion corresponding to the maximum curved portion of the guide flange of the slider is provided on each tape side face of the first sub-body and second sub-body. Then, by inserting the bottom end portions of the fastener stringer through the shoulder mouths of the slider and then pulling the fastener stringer downward with respect to the slider, the first sub-body and second sub-body can be guided along the enlarged width portion of the flange, thereby engaging the first sub-body and the second sub-body.

Because the first sub-body and second sub-body are provided with the curved concave portion, respectively, an interference with the maximum curved portion in the guide flange can be prevented by the same curved concave portion. Consequently, the first sub-body and second sub-body can pass between the maximum curved portions in the guide flange smoothly.

As the first sub-body and second sub-body pass between the maximum curved portions in the guide flange, the first sub-body and second sub-body can be engaged with each other successively. After the first sub-body and second sub-body are engaged with each other completely, they are bonded and fixed by applying fusing means such as ultrasonic thermal melting means to the overlapping stepped portions.

The bottom end stop of a slider chain described in the Great Britain Patent No. 1479363 is constructed of a pair of bottom end stop members. The pair of bottom end stop members can be fixed by engaging stop elements formed on opposing faces with each other. A slider stopper member is formed on the pair of bottom end stop members so as to be expanded toward the slider.

To construct the bottom end stop by engaging the pair of bottom end stop members, the fastener stringers are inserted through the shoulder mouths of the slider, and the fastener stringers are pulled downward. At this time, each stopper member is deformed elastically inward by the flange portion of the slider and then contracted so as to allow the slider to pass through. After the slider passes each stopper member, the stopper member is restored to its expansion state by its elasticity and is expanded outward. When the slider is slid downward thereafter, the bottom end portion of the slider makes contact with each expanded stopper member, thereby preventing the slider from loosing out.

The slide fastener with the terminal described in the Japanese Patent Publication No. 36-19078 has the structure shown in FIGS. 12 and 13. That is, the bottom end stop shown in FIG. 12 comprises terminal members 75, 76 and 77. The terminal member 77 is mounted to a piping 73 of a fastener stringer 71 by pressure forging or mold forging, and the terminal members 75 and 76 are mounted on a piping 73 of a fastener stringer 72 by pressure forging or mold forging.

The bottom ends of the fastener stringers 71, 72 provided with the terminal members 75, 76, 77, engaging teeth 74 and the like are respectively inserted through shoulder mouths of a slider 96 as shown in FIG. 13, and moved along a guide path formed by flanges 97 and a diamond 95 of the slider 96. Consequently, the connecting between the terminal members 75, 76 and the terminal member 77 is carried out, and the engaging teeth 74 are connected successively. FIG. 12 shows an enlarged view of major portions indicating the connecting of the terminal members 75, 76, 77 and the engaging teeth 74.

A projected portion 78 of the terminal member 76 is coupled with a concave portion 79 in the terminal member 77, and a projected portion 80 of the terminal member 77 is meshed with a concave portion 81 in the terminal member 76. The concave portion 82 of the terminal member 77 extends from the top portion of the terminal member 77 to an intermediate portion of the member 77 so as to form a support face 83, meshing with a projected portion 84 of the terminal member 76. Further, a projected portion 85 is formed on the top face of the terminal member 77 so as to be extended up to the central portion of the member, and further, another projected portion 86 is formed on the bottom portion of the terminal member 77 such that it rises in the center thereby forming a support face 87.

A concave portion 88 having a support face extending up to the middle is formed in the bottom portion of the terminal member 75, and the projected portion 85 of the terminal member 77 makes contact with the same concave portion 88 and is supported by a support face 89. In addition, a projected portion 92 and a concave portion 93 are formed in the terminal member 75, and the projected portion 92 and concave portion 93 mesh with the bottom face side of the engaging tooth 74.

According to the bottom end stops 58, 58*a* described in the U.S. Pat. No. 2,701,401, the bottom end stops 58, 58*a* are guided to the enlarged width portion in the flange portion 54 of the slider 53 while maintaining their straight configurations and then, connected with each other successively from the bottom end side. Also, the protrusions 60, 61 each having a predetermined thickness are formed in opposite directions at the front and rear portions of the engaging head 59. Consequently, there is provided a constitution capable of bearing a force applied in the width direction and a force applied in the direction to the front/rear surfaces.

However, because the projected portions 60, 61 having the predetermined thickness in the engaging head 59 are of the same shape, the projected portions 60, 61 need to be deformed largely in order to connect the bottom end stop 58 with the bottom end stop 58', and for this purpose, a large force is necessary. Moreover, by deforming the projected portions 60, 61 having the predetermined thickness largely, there occurs such a problem that a root portion of each of the projected portions 60, 61 is destroyed, so that a sufficient strength as the bottom end stop cannot be maintained.

Because, when the bottom end stop 58 and the bottom end stop 58*a* are connected with each other, the bottom end stops 58, 58' are connected with each other while maintaining their straight configurations, part of the side edges of the fastener stringers provided with the bottom end stops 58, 58*a* is deformed excessively. Thus, there is such a problem that the mounting positions of the bottom end stops 58, 58*a* on the side edge of the fastener stringers 52, 52 are deflected because of an excessive deformation of the side edge.

Further, because the bottom end stop 58 and the bottom end stop 58*a* are formed in the same shape, when the bottom end stop 58 and the bottom end stop 58*a* are connected with each other, there occurs a difference of step between the right and left sides of the bottom end as the bottom end stop as shown in FIG. 11, which is an undesirable configuration from the viewpoint of the appearance of the slide fastener.

According to the bottom end stop described in the Japanese Utility Model Publication No. 59-25217, a difference of step in the direction of the front and rear surfaces is formed between the first sub-body and the second sub-body, and the protrusion formed on the top face of the step on one side overlaps the concave row formed in the bottom face of the step on the other side such that they are engaged. Further, in order to prevent these overlapping stepped portions from being separated by an external force, the stepped portions need to be fixed by using such fusing means as ultrasonic thermal melting for the stepped portions.

Thus, to construct the bottom end stop, the fusing step is required, and pulling in the width direction of the fastener tape, that is, in the right and left direction sides of the fastener tape is resisted by only a fusing force. For the reason, unless the fusing is carried out securely, the strength against the pulling in the right and left directions is insufficient thereby causing a destruction, which is a problem to be solved.

Although the bottom end stops disclosed in the U.S. Pat. No. 2,701,401, Great Britain Patent No. 1479363 and Japanese Patent Publication No. 36-19078 are capable of solving the problem which occurs in the Japanese Utility Model Publication No. 59-25217, the bottom end stop described in the U.S. Pat. No. 2,701,401 includes the above-described problem. In the pair of bottom end stop members described in the Great Britain Patent No. 1479363, the hook-shaped coupling heads formed on opposing faces of the pair of bottom end stop members are projected toward the mating members which mesh with those hook-like shapes.

Therefore, to combine the coupling heads described in the Great Britain Patent No. 1479363 with each other, engaging pieces of the coupling head need to be deformed largely. To deform the engaging piece of the coupling head largely, a large force is necessary. To generate a large force, the coupling heads cannot be slid smoothly with respect to the flange portion of the slider. Moreover, there exists such a problem that a crack occurs at the root portion of the engaging piece because of deformation by a large force or a crack occurs at the root portion of the coupling head itself, so that no sufficient coupling strength can be secured in the engaging piece and coupling head.

In the bottom end stop described in the Great Britain Patent No. 1479363, the stopper members for preventing the slider from loosing out need to be formed in each of the pair of bottom end stop members. Further, because of the constitution which prevents the slider from loosing out with only the stopper member, tearing resistance necessary for blocking the slider weakens gradually as the slider loosing preventing operation is repeated, and by repeating the slider loosing preventing operation, the stopper member can be ruptured near the root portion thereof.

In the bottom end stop described in the Japanese Patent Publication No. 36-19078, the projected portion from one terminal member and the projected portion from the other terminal member are formed to face in opposite directions. Therefore, the projected portion 78 of the terminal member 76 is largely rotated with respect to the projected portion 80 of the terminal member 77, whereby the projected portions can be engaged with each other, and the projected portions 78, 80 can be engaged with each other without deforming largely. However, because only one pair of projected portions engage, the engagement of the pair of projected portions is released easily if a rotation opposite to a rotation for engagement is applied, which is a problem which should be solved.

In addition, because the terminal member 75 and the terminal member 76 to be mounted on the fastener stringer 72 are disposed with an interval, they can be passed through the maximum curved portion in the flange 97 of the slider 96 in a state in which the straight configuration is maintained as shown in the U.S. Pat. No. 2,701,401 and Japanese Utility Model Publication No. 59-25217.

However, the terminal member 75 for preventing the slider from loosing out and the terminal member 76 for connection in order to fix the bottom end stop are constructed separately with an interval. Therefore, when the fastener stringer 72 is pulled in the right and left directions, the terminal member 75 and the terminal member 76 are moved independently depending on how the force for pulling in the right and left direction sides is applied, so that a resistance force against the pulling force in the right and left directions is weakened. Furthermore, the terminal member 75 and the terminal member 76 cannot make a sufficient contact with the diamond of the slider depending on the arrangement positions of the terminal member 75 and the terminal member 76 and the diamond rides over the terminal member 75, thereby not performing the slider loosing preventing operation sufficiently.

Further, the terminal member 75 and the terminal member 76 having a different shape need to be mounted on the piping 73 on the fastener stringers 72 with an interval, and additionally, positioning thereof with respect to the terminal member 77 attached to the piping 73 on the fastener stringer 71 takes long time and much labor.

An object of the present invention is to solve the above-described problems and provide a bottom end stop for a slide fastener having such a structure which facilitates connection of a first member and a second member to be attached to a pair of fastener stringers and having a sufficient strength as the bottom end stop and an excellent appearance.

SUMMARY OF THE INVENTION

To achieve the above-described object, according to a main aspect of the present invention, there is provided A bottom end stop for a slide fastener, having a two-division type configuration including a first member and a second member attached to opposing fastener stringers, respectively, being characterized in that at least two pairs of hook-shaped coupling head and coupling concave portion are respectively formed on opposing faces of the first member and the second member, a direction of a front end of each coupling head of the first member and a direction of a front end of each coupling head of the second member are opposite to each other, the coupling head of the first member is fitted to the coupling concave portion of the second member while the coupling head of the second member is fitted to the coupling concave portion of the first member, and any one of the first member and the second member has an engaging portion which engages a fastener element adjacent to the bottom end stop, and a length in a longitudinal direction of the one member having the engaging portion is larger than that in a longitudinal direction of the other member.

Consequently, two or more pairs of the hook-shaped coupling heads formed on each of the opposing faces of the first member and the second member can engage two or more pairs of the coupling concave portions formed in the mating coupling member, and the coupling state can be made firm. Further, because even if a rotation force is applied between the coupling head and the coupling concave portion, the applied force can be supported by two or more coupling positions, and therefore, the coupling state between the coupling head and the coupling concave portion can be stably obtained.

In addition, because the direction of the coupling head of one member and the direction of the coupling head of the other member are opposite to each other, the rotation of the coupling head of the one member trying to engage the coupling concave portion in the other member and the rotation of the coupling head on the other member trying to engage the coupling concave portion in the one member are carried out in opposite directions. Consequently, the operation for coupling the coupling head with the coupling concave portion can be carried out easily and smoothly.

Preferably, the fastener elements are provided continuously on the opposing fastener stringers so as to form fastener chains, and the engaging portion has a contact portion with which a diamond of a slider having passed through the fastener chains can make contact.

Accordingly, when the slider descends, the diamond of the slider makes contact with the contact portion formed on the proximal end side of the engaging portion, thereby preventing the slider from loosing out securely. In addition, because the contact portion can be formed as part of the first member or the second member having the engaging portion formed therein, the stiffness of the contact portion can be enhanced.

Preferably, the coupling head of the first member and the second member comprises a front surface side coupling head and a rear surface side coupling head, the front surface side coupling head and the rear surface side coupling head are deflected to each other to form a coupling stepped portion, and the respective coupling stepped portions overlap each other.

Consequently, the coupling head on one member of the first member and the second member can engage such that it is accommodated in the coupling concave portion in the other member, and the coupling head on the other member can engage such that it is accommodated in the coupling concave portion in the one member. Further, because the respective coupling stepped portions overlap each other, a force applied to the bottom end stop in the direction to the front/rear surfaces thereof can be resisted by the coupling stepped portion.

As for the constitution of the coupling stepped portion, the coupling stepped face may be formed in the coupling concave portion of a mating member in which the front surface side coupling head and the rear surface side coupling head, constituting the coupling head, are coupled with each other, and as a consequence, both the coupling stepped faces overlap such that the coupling stepped face formed protrudedly on the coupling head corresponds to the coupling stepped face formed in the coupling concave portion so that it is retreated.

Moreover, the contact face between the coupling head and the coupling concave portion with which the coupling head engages may be formed as an inclined face formed from the front surface side to the rear surface side of the first member 11 and the second member 21, so that the inclined faces overlap each other. The inclined face may be formed as a straight inclined face or a curved inclined face. If the inclined faces are formed as the curved faces, it is desirable to form one inclined face as a convex curved face and the other inclined face as a concave curved face.

The portion in which the coupling stepped portion is formed may be formed on an entire contact face on which the coupling head and the coupling concave portion make contact with each other or may be formed on some positions of the aforementioned contact face. If the stepped portion is formed on the entire contact face or on some positions with each interval, it is permissible to construct so that the overlapping configurations of the contact faces in the entire contact face between the first member and the second member are equal, or to construct the stepped portions adjacent to each other in the form of different configurations.

Preferably, corner portions at least on opposing face sides of the corner portions of bottom ends of the first member and second member are chamfered.

Consequently, when the first member and the second member are slid in the guide path of the slider, the contact state between one corner portion and the other corner portion can be maintained in a preferable state. Further, because the first member and the second member can be slid smoothly along the guide path of the slider, the coupling between the first member and the second member can be carried out smoothly.

Preferably, the member having the engaging portion, out of the first member and second member, has a concave portion on a portion on a tape side face side which is an opposite side to a portion on the engaging portion side having the coupling concave portion formed thereon.

Accordingly, in the member having the engaging portion, the concave portion can be formed in the portion of the coupling concave portion on the side of the tape side face symmetrical to the portion in which the coupling concave portion is formed on the engaging portion side.

Consequently, when the bottom end portions of the fastener stringers provided with the first member, the second member and the fastener elements and the like are inserted through the shoulder mouths of the slider so as to form a slide fastener, a portion near the top end portion of the first or second member having the engaging portion which is pressed by the diamond of the slider can be distorted easily in the direction of decreasing a pressure force from the diamond by the operation of the concave portion, namely, to the flange side of the slider.

Accordingly, the fastener stringers can be passed smoothly along the substantially Y-shaped guide path formed by the guide flanges and the diamond of the slider. Moreover, because the portion near the top end of the first member or the second member having the engaging portion is distorted in the direction of leaving the diamond, fitting between the coupling head formed in the first member or the second member and the coupling concave portion formed in the second member or the first member can be carried out easily.

Further, the portion near the top end of the first member or the second member having the engaging portion can be distorted in the direction of leaving the diamond by the concave portion. As a consequence, the range in which the coupling head and the coupling concave portion can be engaged with each other, namely, the range in which the coupling head and the coupling concave portion can be coupled with each other during moving of the fastener stringers with respect to the slider can be expanded.

As for the number of the concave portions to be formed, at least one can be formed, and as for the configuration of the concave portion, the portion near the top end of the first member or the second member can be formed to be likely to be elastically deformed. After the coupling head is coupled with the coupling concave portion, the coupling state between the coupling head and the coupling concave portion can be made firm by elastic restoration of the portion near the top end of the first member or the second member.

When the opposing face side of the engaging portion makes contact with the diamond, the engaging portion side is distorted around the concave portion. Therefore, even if the engaging portion is projected to the opposing face side, the first member and the second member can slide sufficiently smoothly through the guide path of the slider. Further, the engaging portion is projected to the opposing face side, whereby the coupling state with a fastener element adjacent to the bottom end stop can be secured sufficiently.

Preferably, as for a width between the tape side face and the opposing face of the first member and second member, a minimum width at a portion having the concave portion formed thereon is smaller than a minimum width at a portion having no concave portion formed thereon.

As a consequence, the amount of distortion due to the operation of the concave portion can be increased. In this manner, when the first member and the second member are coupled with each other to achieve connection, the first member and the second member are allowed to pass through the guide path of the slider smoothly. In addition, the connection between the first member and the second member can be carried out easily.

Preferably, when the first member and second member are coupled with each other, the bottom ends of the first member and the second member are disposed to be flush with each other.

As a consequence, the bottom ends are arranged in a straight line, so that it is possible to obtain a slide fastener beautiful to see.

DESCRIPTION OF THE PREFERRED EMBODIMENTS

Preferred embodiments of the present invention will be explained below with reference to the accompanying drawings. As for a configuration of a bottom end stop of the invention, in addition to the shapes and arrangements described later, any shapes and arrangements can be employed as long as they can solve the problems of the invention. Therefore, the invention is not limited to the following embodiments, and various modifications are possible.

First Embodiment

Figure 1:
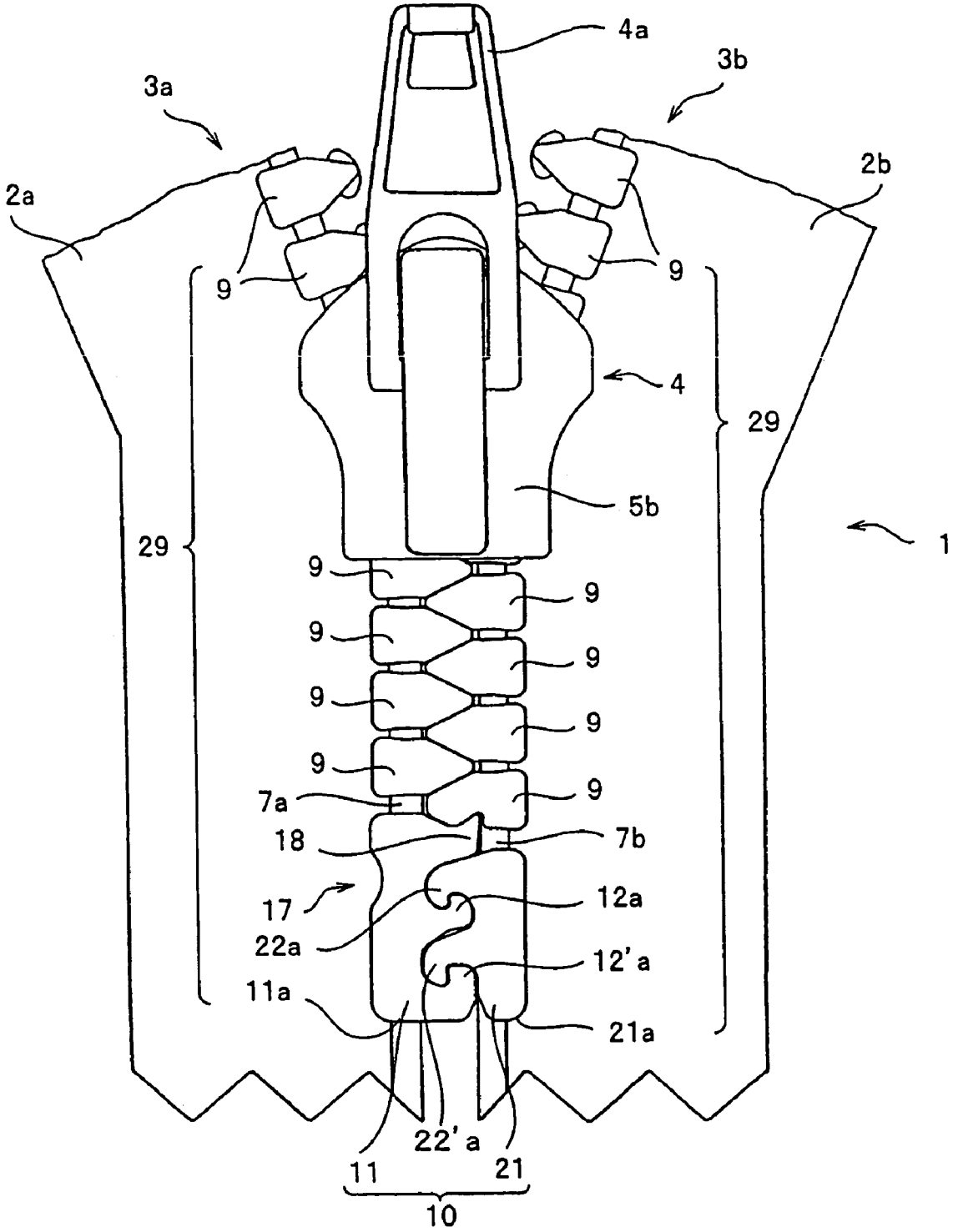
FIG. 1 is a partially enlarged view of a slide fastener having a bottom end stop for a slide fastener according to an embodiment of the present invention (first embodiment)
Figure 2:
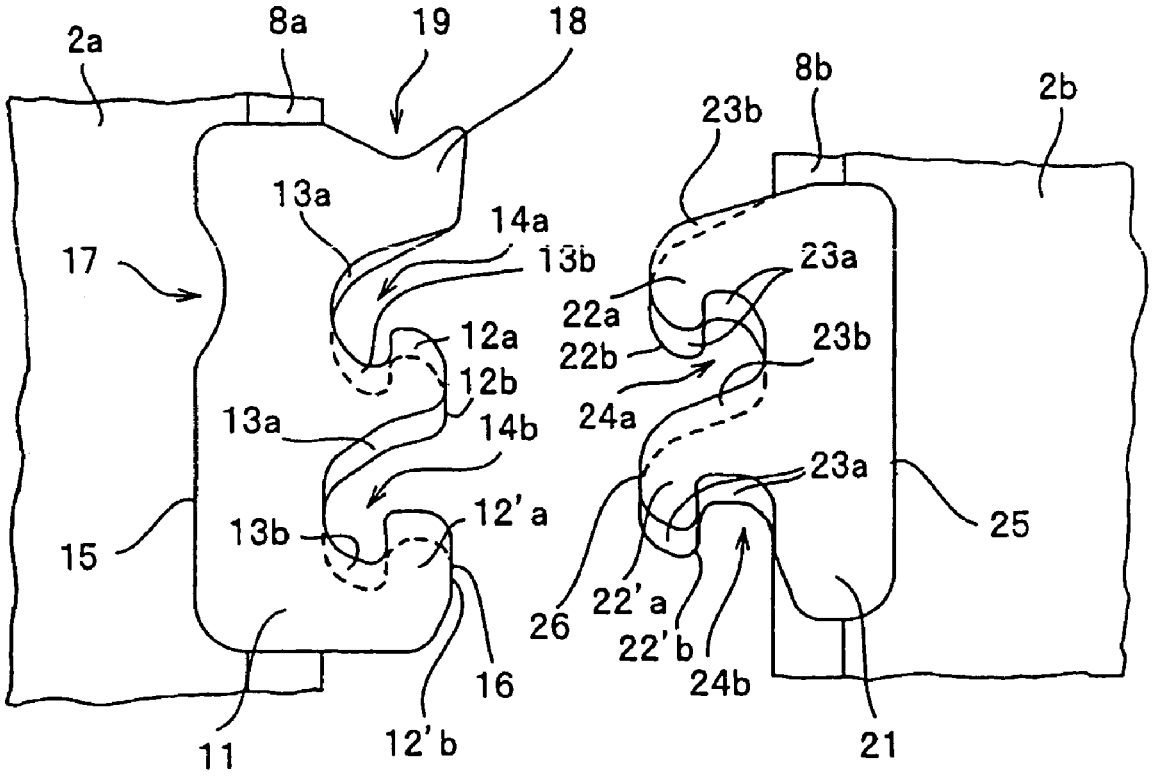
FIG. 2 is a plan view of a first member and a second member constituting the bottom end stop (first embodiment)
Figure 4:
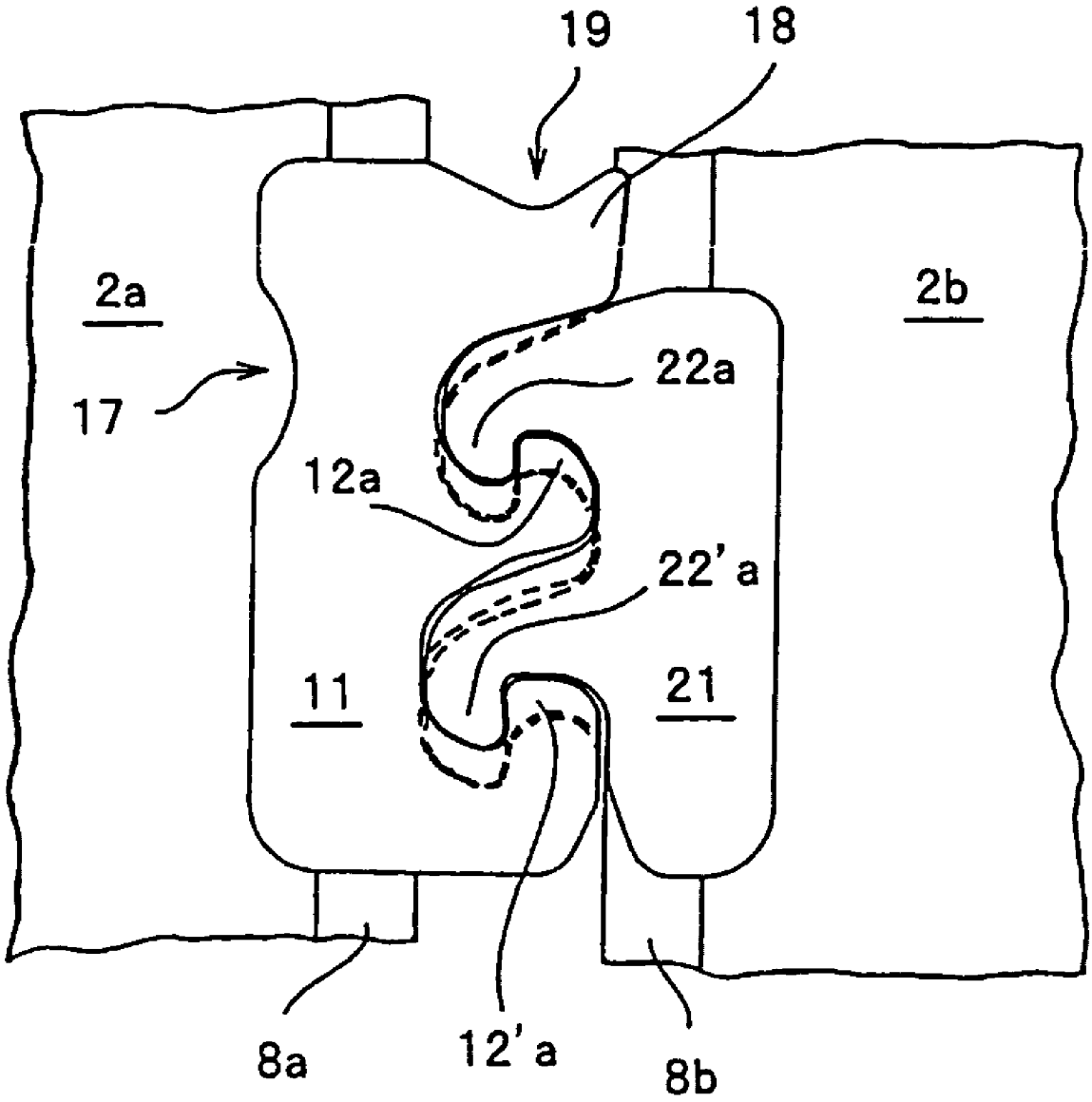
FIG. 4 is a plan view showing a connecting state of the first member and the second member (first embodiment)
Figure 5:
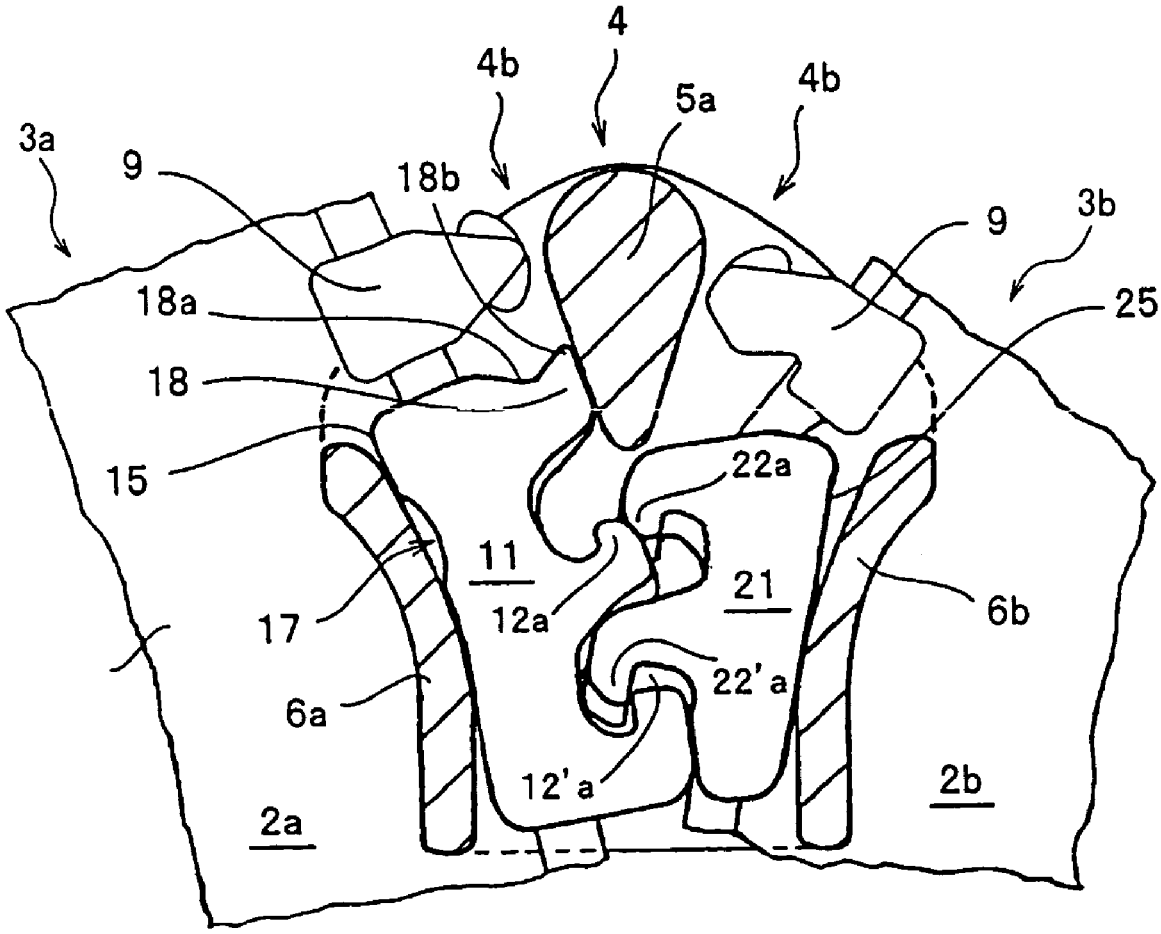
FIG. 5 is a sectional view of major portions showing a state in which the first member and the second member are being connected with each other (first embodiment)
Figure 6:
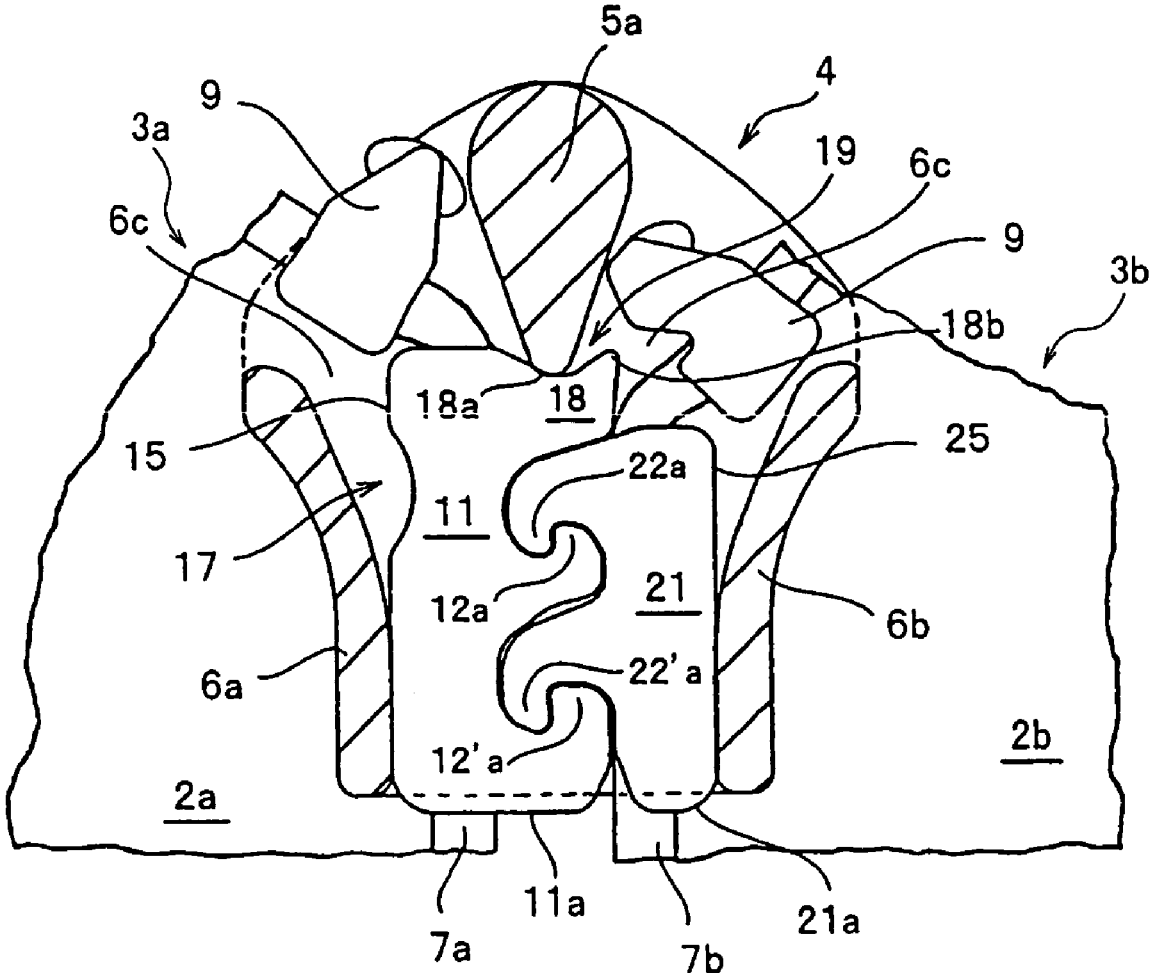
FIG. 6 is a sectional view of major portions showing a state in which the first member and the second member have been connected with each other (first embodiment)

FIG. 1 is a partially enlarged view of a slide fastener having a bottom end stop for a slide fastener according to one embodiment of the present invention. FIG. 2 is a plan view of a first embodiment and a second member constituting the bottom end stop. FIGS. 3A to 3D are plan views and side views of the first member and the second member, respectively. FIG. 4 is a plan view showing a connecting state of the first member and the second member. FIG. 5 is a plan view showing a state in which the first member and the second member are being connected with each other. FIG. 6 is a sectional view of major portions showing a state in which the first and the second member have been connected with each other. In FIGS. 2 and 4, fastener elements 9 are omitted to facilitate explaining of the configuration of a first member 11 and a second member 21, and in FIG. 3, the fastener elements 9 are expressed.

As shown in FIG. 1, in a slide fastener 1, a bottom end stop 10, fastener elements 9 and a top end stop (not shown) are attached to core threads provided on symmetrical lines of a pair of fastener stringers 3*a*, 3*b*, and a slider 4 is disposed so as to go through fastener chains 29 each composed of plural fastener elements 9. The bottom end stop 10 for blocking the slider 4 from loosing out and the top end stop (not shown) are disposed at the top and bottom ends of the fastener chain 29.

As the fastener element, engaging teeth formed on fastener tapes 2*a*, 2*b* molded by injection molding are exemplified. However, the fastener element is not restricted to the one constituted of the engaging teeth, and it is permissible to employ a coil-like or zigzag-like fastener element, a metallic fastener element or the like.

The bottom end stop 10 comprises the first member 11 attached to the woven/knit fastener tape 2*a* and the second member 21 attached to the fastener tape 2*b*. In an opposing face 16 of the first member 11 on the side of the second member 21 are formed a pair of hook-shaped coupling heads 12*a*, 12*b*, a pair of coupling concave portions 14*a*, 14*b* to which a pair of coupling heads of the second member 21 are fitted, and an engaging portion 18. Then, a concave portion 17 which allows elastic deformation of a portion including the engaging portion 18 is formed in a tape side face 15 on an opposite side to the opposing face 16.

In an opposing face 26 of the second member 21 on the side of the first member 11 are formed coupling concave portions 24*a*, 24*b* to which the pair of hook-shaped coupling heads 12*a*, 12*b* are fitted, and a pair of hook-like coupling heads 22*a*, 22*b* which are fitted to the pair of coupling concave portions 14*a*, 14*b* of the first member. The coupling heads 12*a*, 12*b* of the first member 11 are formed to face in the direction of the fastener elements 9 and the coupling heads 22*a*, 22*b* of the second member 21 are formed in an opposite direction to the coupling heads 12*a*, 12*b* of the first member 11.

A preferred example in which two coupling heads and coupling concave portions each are formed has been described above. According to the invention, however, the number of each of the coupling heads and coupling concave portions is not restricted to two, and an appropriate number of them is permitted to be formed.

A bottom end 11*a* of the first member 11 and a bottom end 21*a* of the second member 21 are disposed on the same line on the side of the end portion of the fastener tape. Consequently, as the slide fastener 1, the bottom end stop 10 can be formed in a neat configuration, so that a good appeared slide fastener can be provided.

As shown in FIG. 2, coupling steps 13, 23 are formed in respective contact faces between the coupling heads 12*a*, 12*b* of the first member 11 and the coupling concave portions 24*a*, 24*b* of the second member 21 and respective contact faces between the coupling concave portions 14*a*, 14*b* of the first member 11 and the coupling heads 22*a*, 22*b* of the second member 21.

Figure 3A:
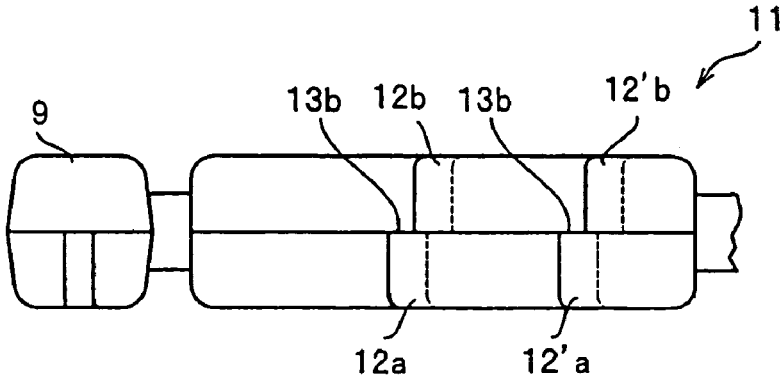
FIGS. 3A to 3D are plan views and side views of the first member and the second member (first embodiment)
Figure 3B:
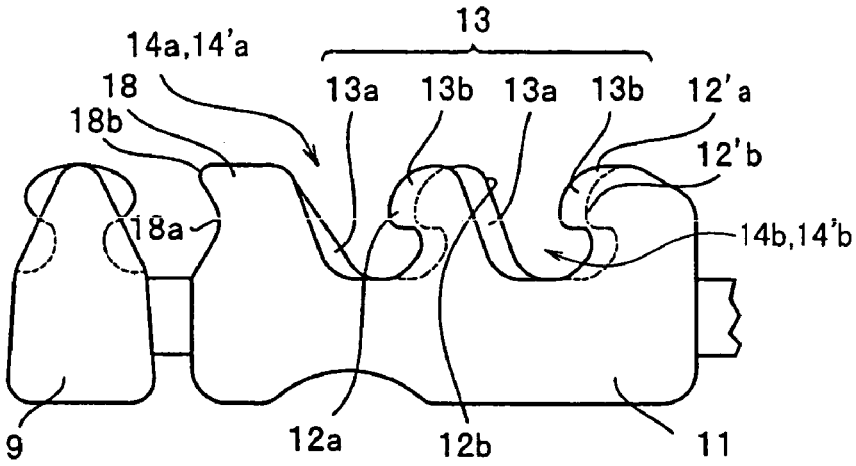

As shown in the side view and plan view of the first member 11 and the fastener element 9 shown in FIGS. 3A and 3B, the coupling step 13 formed in the middle portion in the thickness direction of the first member 11 is constituted of a coupling stepped portion 13*a* which faces upward with respect to the front surface of the first member 11 and a coupling stepped portion 13*b* which faces downward with respect to the rear face of the first member 11.

Figure 3C:
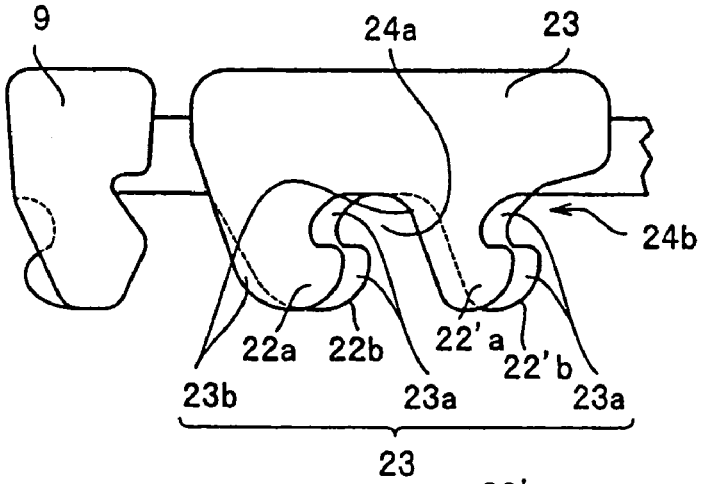
Figure 3D:
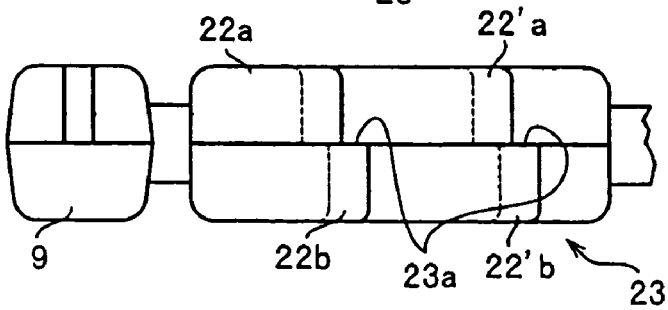

As shown in the plan view and side view of the second member 21 and the fastener element 9 shown in FIGS. 3C and 3D, the coupling step 23 formed in the middle portion in the thickness direction of the second member 21 is constituted of a coupling stepped portion 23*a* which faces upward with respect to the front surface of the second member 21 and a coupling stepped portion 23*b* which faces downward with respect to the rear surface of the second member 21.

That is, with respect to the coupling heads 12*a*, 12*a*' and the coupling concave portions 14*a*, 14*a*' formed on the front surface side of the first member 11, the coupling heads 12*b*, 12*b*' and the coupling concave portions 14*b*, 14*b*' formed on the rear surface side of the same first member 11 are deflected in the direction of the bottom end of the bottom end stop 10, and the coupling stepped portions 13*a*, 13*b* are formed at the deflected portions.

Likewise, with respect to the coupling heads 22*a*, 22*a*' and the coupling concave portion 24*a* formed on the front surface side of the second member 21, the coupling heads 22*b*, 22*b*' and the coupling concave portion 24*b* formed on the rear surface side of the second member 21 are deflected in the direction of the bottom end of the bottom end stop 10, and the coupling stepped portions 23*a*, 23*b* are formed at the deflected portions. In the meantime, if necessary, the coupling stepped portions 13*a*, 13*b* and the coupling stepped portions 23*a*, 23*b* may be deflected to the sides of opposing faces of the first member 11 and the second member 21 as well.

Because the coupling step 13 of the first member 11 and the coupling step 23 of the second member 21 are deflected each, when the first member 11 and the second member 21 are coupled with each other, the coupling steps 13, 23 overlap each other so as to be capable of standing a force acting in the direction of the front/rear surfaces.

That is, as shown in FIG. 4, when the first member 11 and the second member 21 are connected with each other, the coupling head and the coupling concave portion are coupled to form a coupling state, and the coupling stepped portion 13*a* and the coupling stepped portion 23*b* make contact with each other while the coupling stepped portion 13*b* and the coupling stepped portion 23*a* make contact with each other so as to form a contact state between the coupling step 13 and the coupling step 23. Consequently, even if a force intending to separate the first member 11 and the second member 21 is applied in the up/down direction, front surface/rear surface direction and right/left direction of the slide fastener 1, the connecting state between the first member 11 and the second member 21 can be maintained firmly.

As shown in FIGS. 2 to 4, the coupling stepped portion 13*a* in the coupling concave portion 14*a* of the first member 11 and the coupling stepped portion 13*a* in the coupling concave portion 14*b* are formed in the same direction, and further, the coupling stepped portion 13*b* in the coupling concave portion 14*a* and the coupling stepped portion 13*b* in the coupling concave portion 14*b* are formed in the same direction. Likewise, the coupling stepped portions 23*a*, 23*b* on the coupling heads 22*a*, 22*b* of the second member 21 are respectively formed in the same direction like the first member.

The formation direction of the coupling stepped portion 13*a*, 13*b* in the coupling concave portion 14*a* and the formation direction of the coupling stepped portion 13*a*, 13*b* in the coupling concave portion 14*b* are permitted to be different from each other. In this case, it is necessary to form the coupling stepped portions 23*a*, 23*b* in the second member 21 in a direction of making contact with the coupling stepped portion 13*b*, 13*a*.

Consequently, by the contact face of the coupling steps 13, 23 in addition to the connecting action by coupling between the coupling heads 12*a*, 12*b* and the coupling concave portions 24*a*, 24*b* and coupling between the coupling heads 22*a*, 22*b* and the coupling concave portions 14*a*, 14*b*, the connecting state of the first member 11 and the second member 21 can be maintained firmly even if a force for separating the first member 11 and the second member 21 is applied in the front/rear surface direction, the right/left direction and up/down direction of the slide fastener 1.

Particularly, since the front end of the coupling heads 12*a*, 12*b* and the front end of the coupling heads 22*a*, 22*b* face in opposite directions, the work for coupling the coupling head and the coupling concave portion is facilitated, and no unreasonable force is applied on the coupling head upon coupling of the coupling head and the coupling concave portion. Consequently, generation of destruction, crack and the like in the coupling head or the like accompanied by the coupling operation is prevented, so that a desired strength as the bottom end stop is ensured.

Also, the coupling heads and the coupling concave portions which engage the coupling heads are formed in two pairs each. Therefore, even if a rotation force is applied in the direction of releasing the coupling state between the coupling head and the coupling concave portion, the coupling state between the coupling head and the coupling concave portion can be stabilized against the the rotation force, because the rotation force is received by the coupling heads and coupling concave portions at two positions in the coupling state.

FIGS. 2 to 4 show an example in which the coupling stepped faces are formed as the coupling steps 13, 23. The coupling step is not restricted to the coupling stepped face, but may be formed as an inclined face formed in the direction from the front surface side to the rear surface side of the first member 11 and the second member 21. Further, when forming the coupling stepped faces, it is permissible to form plural stages of the steps, not a single stage step.

Further, it is permissible to form a jaw portion projected from one member to the other member on the front surface side of the first member 11 or the second member 21 while forming a concave portion for accommodating the jaw portion on the front surface side of the other member, and also on the rear surface of the first member 11 and the second member 21, the jaw portion and the concave portion for accommodating the jaw portion may be formed like the front surface side. In addition, it is permissible to form a coupling stepped portion of another appropriate type.

The connecting configuration for connecting the first member 11 and the second member 21 will be described with reference to FIGS. 5 and 6. The bottom ends of the pair of fastener stringers 3*a*, 3*b* in which the first member 11, the fastener elements 9 and the top end stop (not shown); and the second member 21, the fastener elements 9 and the top end stop (not shown) are attached to the fastener tapes 2*a*, 2*b*, respectively, are inserted through shoulder mouths 4*b*, 4*b* of the slider 4.

Thereafter, the fastener stringers 3*a*, 3*b* are drawn out of the slider 4 downward or the slider 4 is slid upward along the fastener stringers 3*a*, 3*b*.

At this time, tape side faces 15, 25 of the first member 11 and the second member 21 slide along flanges 6*a*, 6*b* of the slider 4, and the coupling head 12*b* of the first member 11 is fitted to the coupling concave portion 24*b* in the second member 21 so that they are connected. The engaging portion 18 of the first member 11 which makes contact with a diamond 5*a* is deflected elastically to the side of the flange 6*a* due to the operation of the concave portion 17.

As for the formation position of the concave portion 17, the concave portion 17 is preferred to be formed at a position which allows the engaging portion 18 to be deformed easily. Particularly, if the concave portion 17 is formed below the width enlargement starting position of the guide flange 6*a*, when the slider 4 is located at the bottom end of the slide fastener 1, the posture of the slider 4 is difficult to secure. Therefore, the concave portion 17 is more preferred to be formed above the width enlargement starting position of the guide flange 6*a* to the shoulder mouth 4*b*.

Due to the elastic deformation of the engaging portion 18, the first member 11 and the second member 21 are guided smoothly along a guide path 6*c*. Moreover, because the engaging portion 18 is deflected elastically to the side of the flange 6*a*, the opening of the coupling concave portion 14*a* can be enlarged, so that fitting of the coupling head 22*a* to the coupling concave portion 14*a* can be performed easily.

If a pressing force from the diamond 5*a* to the engaging portion 18 is decreased or released as shown in FIG. 6, the engaging portion 18 is restored elastically so that the coupling state between the coupling head 22*a* and the coupling concave portion 14*a* can be made firm. Further, if the fastener stringers 3*a*, 3*b* are moved downward relative to the slider 4, the fastener element 9 adjacent to the bottom end stop 10 is coupled with a projected portion 18*b* of the engaging portion 18, and the fastener elements 9 are coupled with each other successively, so that the state shown in FIG. 1 is obtained.

In the state shown in FIG. 1, the slider 4 is placed so as to go through the fastener chains 29, and when the slider is moved upward, the slide fastener 1 can be closed, and when the slider 4 is slid downward, the slide fastener 1 can be opened. Further, when the slider 4 is slid downward to open the slide fastener 1, the diamond 5*a* of the slider 4 makes contact within an accommodating portion 19 of the first member 11, thereby preventing the slider 4 from loosing out.

The corner portions at the bottom end of the first member 11 and the second member 21 and the corner portion on the tape side face at the top end thereof are chamfered. Particularly, because the corner portions on the side of the opposing face are chamfered, when the first member 11 and the second member 21 are coupled with each other as shown in FIG. 5, it is possible to prevent the corner portions from being coupled with the opposing face of the other member and sliding. As a consequence, the connection of the first member 11 and the second member 21 can be performed smoothly.

The front end portions of the coupling heads 12*a*, 12*b* and the front end portions of the coupling heads 22*a*, 22*b* are formed to face in opposite directions. Accordingly, when the coupling heads 12*a*, 12*b* of the first member 11 and the coupling concave portions 24*a*, 24*b* in the second member 21 are coupled with each other, the first member 11 is deformed in a direction of rotating clockwise with respect to the second member 21 while the second member 21 is deformed in a direction of rotating counterclockwise with respect to the first member 11.

Further, the coupling heads 22*a*, 22*b* of the second member 21 can be engaged with the coupling concave portions 14*a*, 14*b* in the first member 11 by same rotation. Consequently, the fitting of the coupling heads and the coupling concave portions can be performed smoothly, thereby intensifying the coupling strength after the coupling is completed.

When the first member 11 and the second member 21 are formed by molding, they can be formed without molding with a sliding core. Consequently, the first member and the second member can be molded easily, so that the manufacturing cost of the first member and the second member can be reduced, thereby finally leading to reduction of the manufacturing cost of the slide fastener.

Second Embodiment

Figure 7:
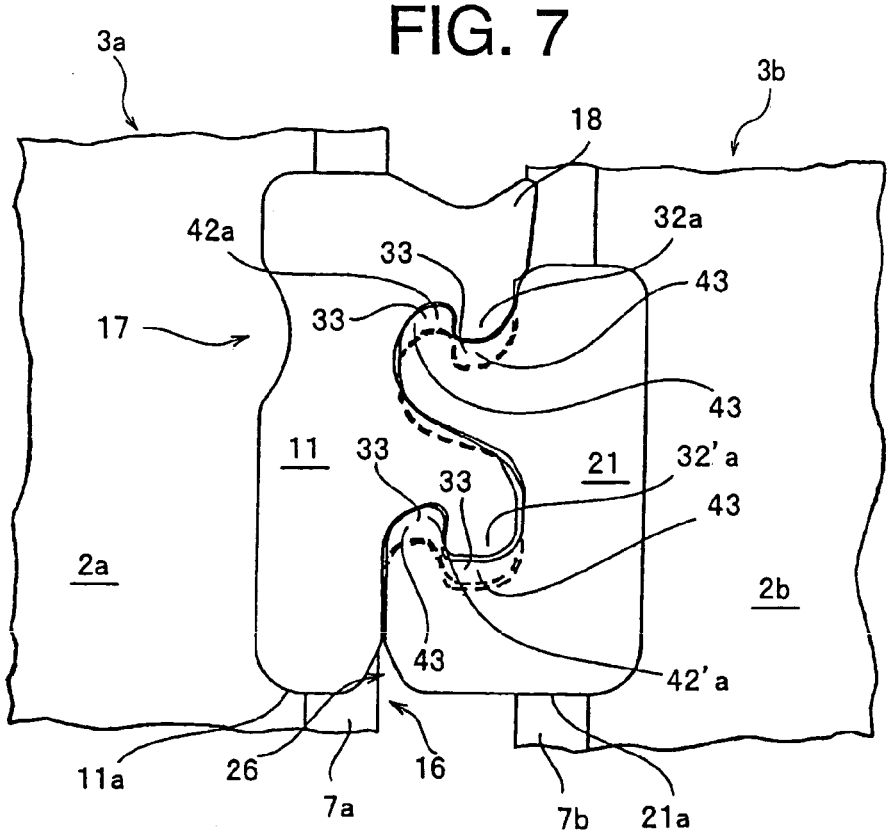
FIG. 7 is a plan view showing a connecting state of the first member and the second member (second embodiment)

FIG. 7 shows a second embodiment according to the present invention in which the direction of the coupling head is opposite to that of the first embodiment. For the second embodiment, by using the same reference numerals as the first embodiments, description of the same components is omitted.

As shown in FIG. 7, coupling heads 32*a*, 32*b*, coupling concave portions and engaging portion 18 are formed in the opposing face 16 of the first member 11 and the concave portion 17 which allows elastic deformation of a portion including the engaging portion 18 is formed in the tape side face 15.

In the opposing face 26 of the second member 21, a pair of coupling concave portions are formed, which are fitted to the pair of coupling heads 32*a*, 32*b* in the first member, and a pair of coupling heads 42*a*, 42*b* which are fitted to the pair of coupling concave portions in the first member 11 are formed on the second member 21.

According to the second embodiment, the directions of the coupling heads 32*a*, 32*b* and the coupling concave portion formed on the opposing face 16 of the first member 11 and the directions of the coupling heads 42*a*, 42*b* and the coupling concave portion formed on the opposing face 26 of the second member 21 are opposite to the directions of the coupling head and coupling concave portion in the first embodiment.

Further, the directions of the coupling head and the coupling concave portion of the second embodiment are opposite to the directions of the coupling head and coupling concave portion of the first embodiment, and at the same time, the formation direction of the coupling stepped face on the coupling steps 33, 43 is opposite to that of the first embodiment.

Consequently, the coupling step 33 of the first member 11 is capable of resisting a force applied in the direction of the rear surface of the slide fastener 1, and the coupling step 43 of the second embodiment is capable of resisting a force applied in the direction of the front surface of the slide fastener 1. A force applied in the right and left directions of the slide fastener 1 can be resisted by the engagement operation between the coupling head and the coupling concave portion.

In the second embodiment also, the bottom end 11*a* of the first member 11 and the bottom end 21*a* of the second member 21 are on the same straight line on the side of the end portion of the fastener tape.

Third Embodiment

Figure 8:
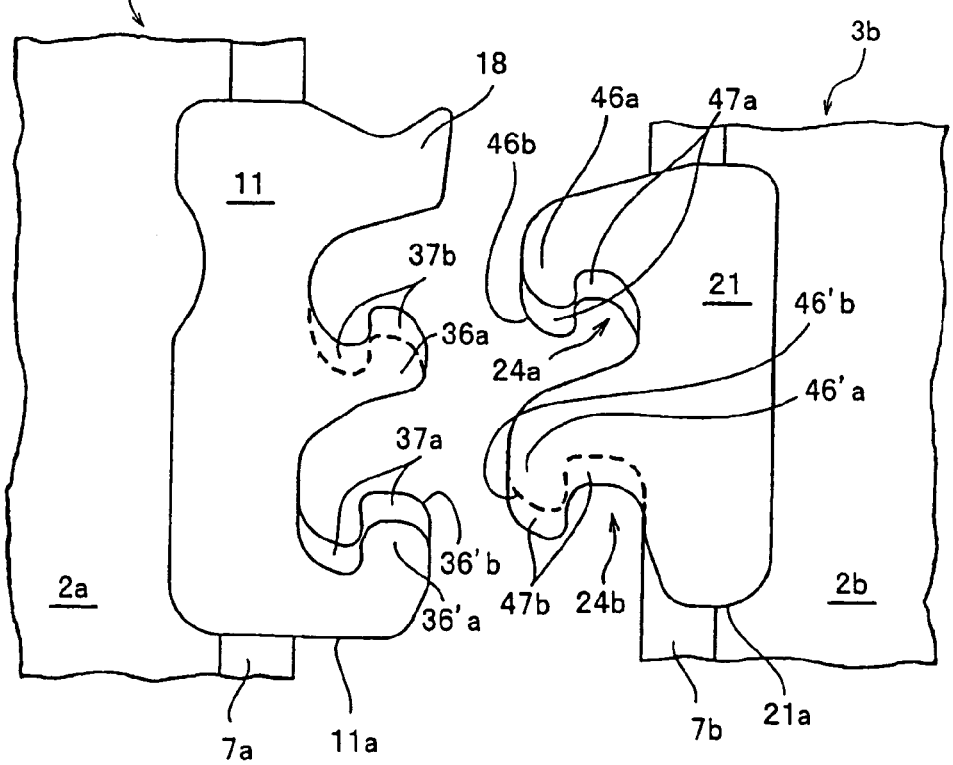
FIG. 8 is a plan view showing the first member and the second member constituting the bottom end stop (third embodiment)
Figure 9:
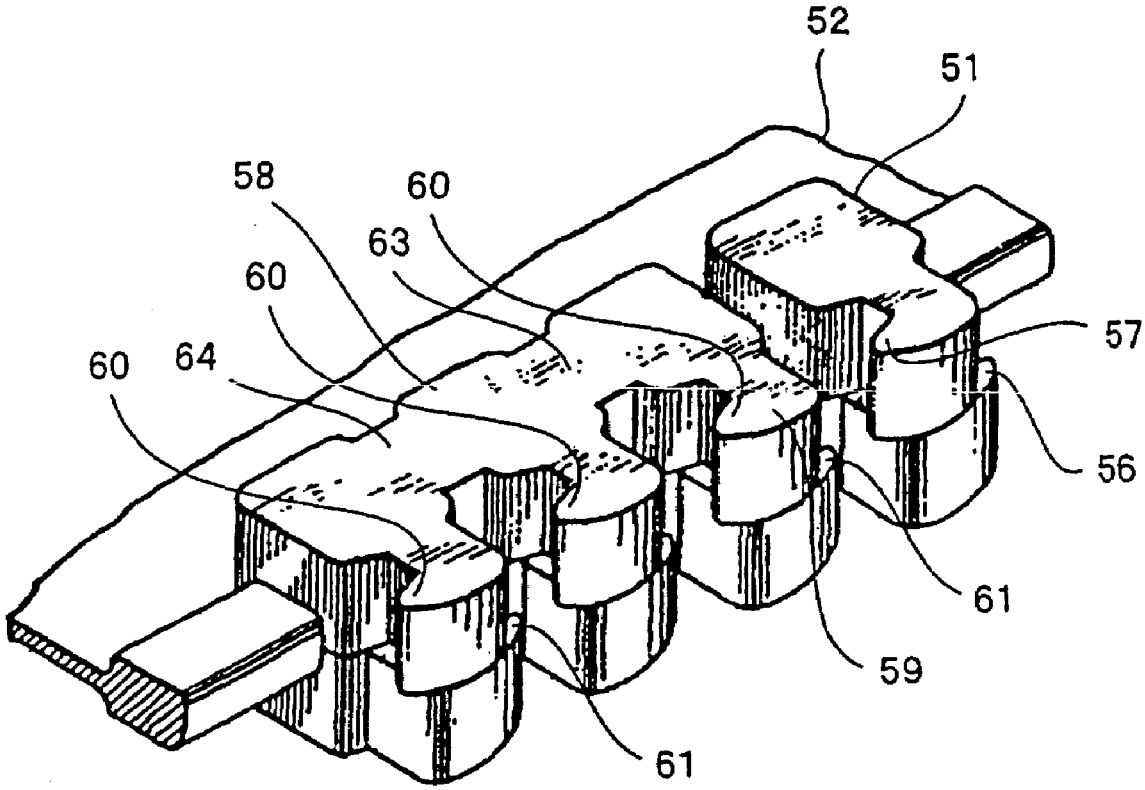
FIG. 9 PRIOR ART
FIG. 9 is a perspective view of one member constituting the bottom end stop (first conventional example)
Figure 10:
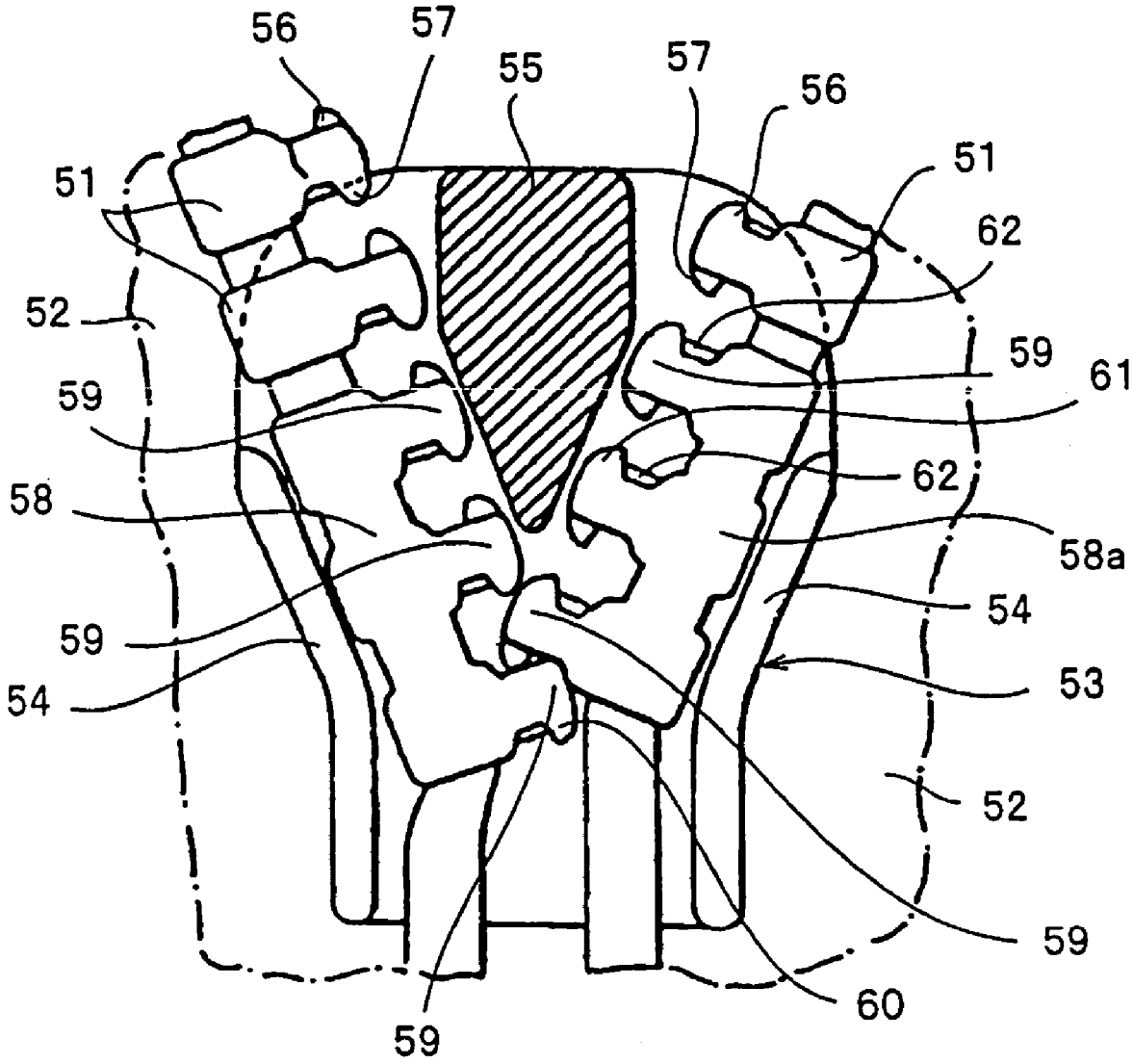
FIG.10 PRIOR ART
FIG. 10 is a plan view including a partial sectional view showing a coupling starting state of the bottom end stop (first conventional example)
Figure 11:
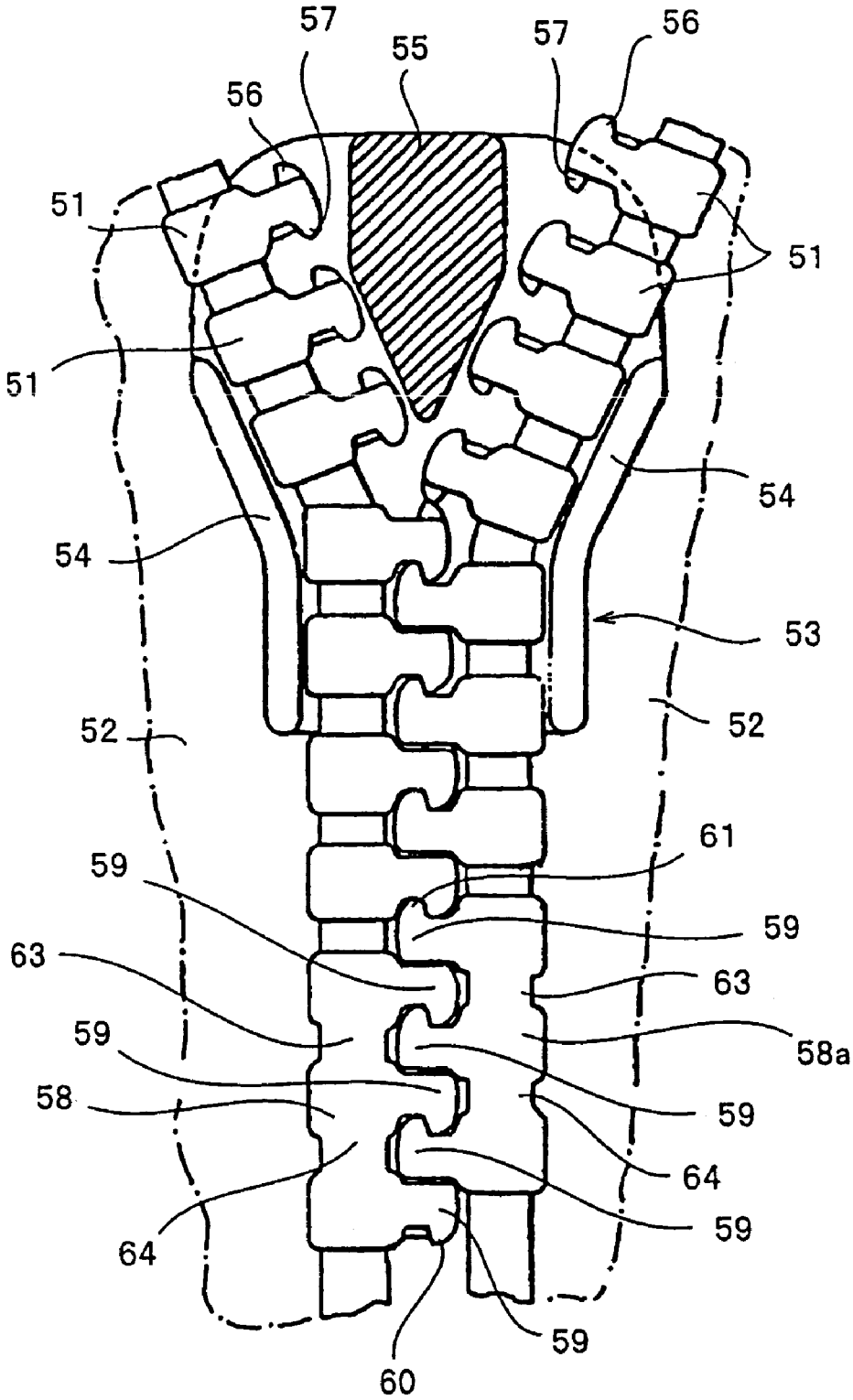
FIG.11 PRIOR ART
FIG. 11 is a plan view including a partial sectional view showing a coupling state of the bottom end stop (first conventional example)
Figure 12:
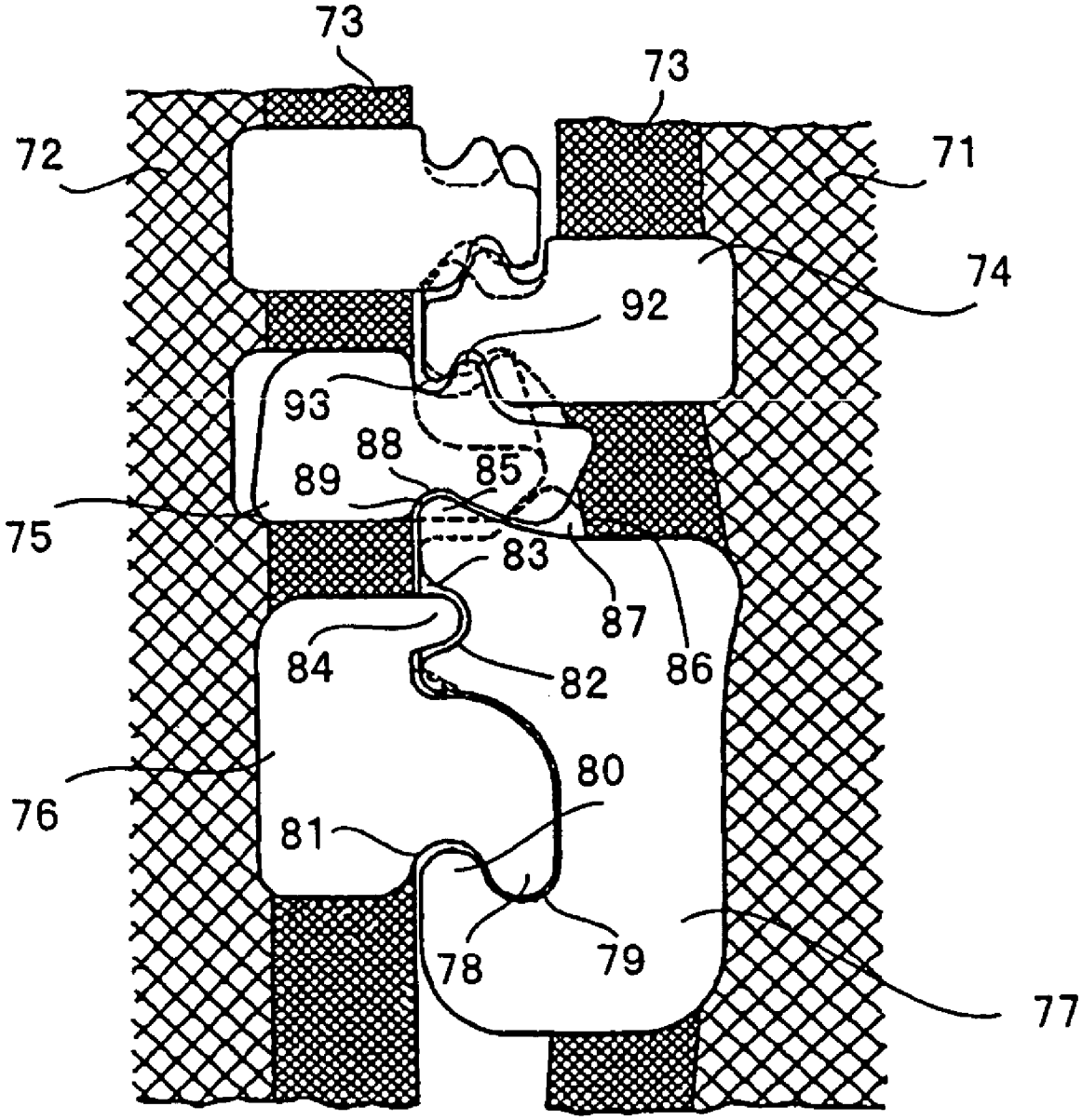
FIG.12 PRIOR ART
FIG. 12 is a plan view showing a coupling state of the bottom end stop (fourth conventional example)
Figure 13:
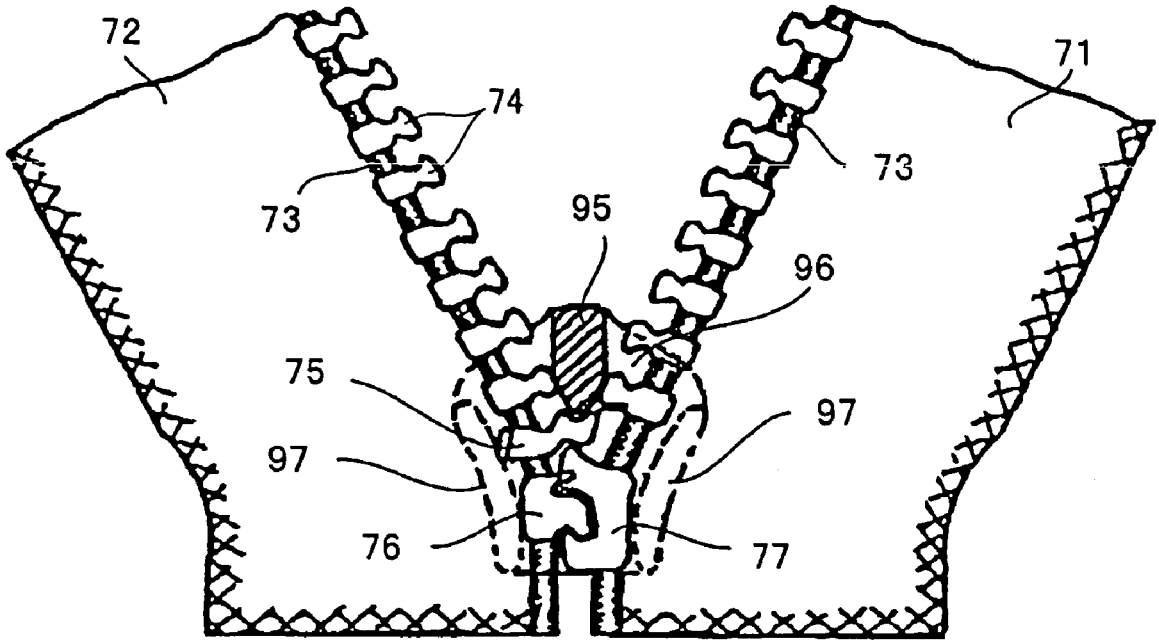
FIG.13 PRIOR ART
FIG. 13 is a plan view showing a state in which the slider is blocked from loosing out (fourth conventional example).

FIG. 8 shows a third embodiment according to the present invention. The formation direction of the coupling stepped face is different from those of the first embodiment and the second embodiment, and at the pair of coupling heads of each member, their coupling steps are formed in different directions. By using the same reference numerals as the first and second embodiments, description of the same structure as the first and second embodiments is omitted.

According to the third embodiment, the formation directions of the coupling stepped faces differ between the coupling stepped portion 37*a* on the coupling head 36*a* and the coupling stepped portion 37*b* on the coupling head 36*b* depending on the formation position of the coupling stepped face at the coupling head. According to the first and second embodiments, as for the formation direction of the coupling steps 13 at the coupling heads 12*a*, 32*a* and the coupling heads 12*b*, 32*b* and the formation direction of the coupling step face at the coupling heads 42*a* and 42*b*, the coupling heads formed on the rear surface side are deflected in the direction to the bottom end with respect to the coupling heads formed on the front surface side and the coupling stepped faces are formed at the deflected portions.

According to the third embodiment also, the coupling stepped face formed in an upward direction and the coupling stepped face formed in a downward direction are provided at the coupling head 36*a* and the coupling head 36*b* of the first member 11. Therefore, they are capable of resisting forces applied in the direction of the front/rear surfaces of the slide fastener 1, and they are capable of resisting a rotation moment acting between the opposing faces of the first member 11 and the second member 21 and force applied in the right/left direction and the back/forth direction of the slide fastener 1 strongly.

By forming plural coupling stepped faces on a single coupling head in different formation directions, forces applied from various directions intending to separate the first member and the second member can be resisted. Further, a force applied to the first member 11 and the second member 21 can be dispersed to the first member 11 and the second member 21, so that the connecting force between the first member 11 and the second member 21 can be intensified.

In the third embodiment also, the bottom end 11*a* of the first member 11 and the bottom end 21*a* of the second member 21 are disposed on the same straight line on the side of the end portion of the fastener tape. Due to the bottom end stop of the present invention, the connecting state between the first member 11 and the second member can be maintained against forces applied in the back/forth direction, right/left direction and front/rear surface direction of the slide fastener 1.

Moreover, the coupling and connection of the first member and the second member can be carried out easily due to elastic deformation of the concave portion 17. Because the corners at the bottom ends 11*a*, 21*a* of the first member 11 and the second member 21 are chamfered, by inserting the fastener stringers 3*a*, 3*b* through the shoulder mouths along the guide path 6*c* of the slider 4, the coupling and connection of the first member 11 and the second member 21 can be carried out easily.

The present invention allows the technical idea of the present invention to be applied to a member, apparatus and the like to which the technical idea of the present invention is applicable.

What is claimed is:

1. A bottom end stop for a slide fastener, having a two-division type configuration including a first member and a second member attached to opposing fastener stringers, respectively, wherein two pairs of a hook-shaped coupling head and a coupling concave portion are respectively formed on opposing faces of the first member and the second member, a front end of each coupling head of the first member and a front end of each coupling head of the second member face opposite directions relative to each other, each coupling head of the first member is fitted to each opposing coupling concave portion of the second member while each coupling head of the second member is fitted to each opposing coupling concave portion of the first member at a time of coupling each coupling head of the first member and each coupling head of the second member, any one of the first member and the second member has an engaging portion which engages a fastener element adjacent to the bottom end stop, and the one member having the engaging portion has a length in a longitudinal direction of the fastener stringer which is larger than a length in a longitudinal direction of the fastener stringer of the other member, and each coupling head of the first member and the second member comprises a front surface side coupling head and a rear surface side coupling head, which are formed integrally and face to a same direction, each front surface side coupling head and each rear surface side coupling head are offset in the longitudinal direction of the fastener stringer to form a coupling stepped portion, and each coupling stepped portion is overlapped with a mating coupling stepped portion at a time of engaging of the first member and second member.

2. The bottom end stop for the slide fastener according to claim 1, wherein fastener elements are provided continuously on the opposing fastener stringers so as to form fastener chains, and the engaging portion has a contact portion with which a diamond of a slider having passed through the fastener chains can make contact.

3. The bottom end stop for the slide fastener according to claim 1 or 2, wherein corner portions at least on opposing face sides of the corner portions of bottom ends of the first member and second member are chamfered.

4. The bottom end stop for the slide fastener according to claim 1 or 2, wherein the member having the engaging portion, of the first member and second member, has a concave portion on a side portion of the member having the engaging portion which is an opposite side in a tape width direction to a portion on the engaging portion side having the adjacent coupling concave portion formed thereon.

5. The bottom end stop for the slide fastener according to claim 1 or 2, wherein, when the first member and second member are coupled with each other, bottom ends of the first member and the second member are disposed to be flush with each other.

* * * * *